US011905655B2

(12) United States Patent
Pace et al.

(10) Patent No.: US 11,905,655 B2
(45) Date of Patent: Feb. 20, 2024

(54) BLACK LIQUOR VISCOSITY REDUCING AND ANTI-SCALE AGENT

(71) Applicant: ECOLAB USA INC., St. Paul, MN (US)

(72) Inventors: Luiz Wanderley Bratfisch Pace, Campinas (BR); Prasad Yogendra Duggirala, Naperville, IL (US)

(73) Assignee: ECOLAB USA Inc., St. Paul, MN (US)

( * ) Notice: Subject to any disclaimer, the term of this patent is extended or adjusted under 35 U.S.C. 154(b) by 505 days.

(21) Appl. No.: 16/941,931

(22) Filed: Jul. 29, 2020

(65) Prior Publication Data

US 2021/0062421 A1 Mar. 4, 2021

Related U.S. Application Data

(60) Provisional application No. 62/894,432, filed on Aug. 30, 2019.

(51) Int. Cl.

| | |
|---|---|
| ***D21C 11/10*** | (2006.01) |
| ***D21C 3/22*** | (2006.01) |
| ***D21C 11/00*** | (2006.01) |

(52) U.S. Cl.

CPC ..... *D21C 11/106* (2013.01); *D21C 3/226* (2013.01); *D21C 11/0092* (2013.01)

(58) Field of Classification Search

CPC .. D21C 11/0085; D21C 11/0092; D21C 11/10

See application file for complete search history.

(56) References Cited

U.S. PATENT DOCUMENTS

| | | | | |
|---|---|---|---|---|
| 3,289,734 | A | 12/1966 | Robertson | |
| 3,516,910 | A | 6/1970 | Engman et al. | |
| 4,255,309 | A | 3/1981 | Klaessig et al. | |
| 4,263,092 | A * | 4/1981 | Klaessig | D21C 11/106 159/DIG. 13 |
| 4,734,103 | A | 3/1988 | Fong et al. | |
| 4,911,787 | A * | 3/1990 | Shimokura | D21C 11/10 162/31 |

(Continued)

FOREIGN PATENT DOCUMENTS

| | | |
|---|---|---|
| EP | 0985690 A2 | 3/2000 |
| WO | 9626316 A1 | 8/1996 |

(Continued)

OTHER PUBLICATIONS

David, Clay, Evaporation Principles and Black Liquor Properties, 2008, TAPPI Kraft Recovery Course (Year: 2008).*

(Continued)

*Primary Examiner* — Anthony Calandra

(74) *Attorney, Agent, or Firm* — Eric D. Babych; Barnes & Thornburg LLP

(57) ABSTRACT

The disclosure provides methods and compositions for reducing the viscosity of black liquor. Also provided are methods of inhibiting deposition of scale and methods of processing black liquor. In some embodiments, the compositions include a carboxylate-containing polymer and an inorganic salt. In some embodiments, the compositions include a carboxylate-containing polymer, an inorganic salt, and a surfactant.

8 Claims, 5 Drawing Sheets

(56) References Cited

U.S. PATENT DOCUMENTS

| | | | | |
|---|---|---|---|---|
| 5,455,328 | A * | 10/1995 | Vuorikari | C11B 13/02 530/206 |
| 5,635,027 | A | 6/1997 | Spontak et al. | |
| 5,900,112 | A | 5/1999 | Spontak et al. | |
| 6,903,062 | B2 | 6/2005 | Griese et al. | |
| 7,666,963 | B2 | 2/2010 | Rodrigues et al. | |
| 7,727,945 | B2 | 6/2010 | Rodrigues et al. | |
| 8,586,015 | B2 | 11/2013 | Panandiker et al. | |
| 8,916,050 | B2 | 12/2014 | de Rijk | |
| 2006/0270769 | A1 | 11/2006 | Shoaf et al. | |
| 2012/0190099 | A1 | 7/2012 | Harris et al. | |
| 2016/0137904 | A1 | 5/2016 | Drake et al. | |
| 2018/0134949 | A1 | 5/2018 | Monastiriotis et al. | |
| 2019/0062187 | A1 | 2/2019 | Dhawan et al. | |
| 2019/0169545 | A1 | 6/2019 | Silvernail et al. | |
| 2021/0002826 | A1 * | 1/2021 | Nicholson | D21C 11/106 |

FOREIGN PATENT DOCUMENTS

| | | | |
|---|---|---|---|
| WO | 2005047443 | A1 | 5/2005 |
| WO | 2009123322 | A1 | 10/2009 |
| WO | 2015193302 | A1 | 12/2015 |

OTHER PUBLICATIONS

D.C. Blackley, Polymer Latices, 1997, Springer-Science_Buisness Media, B.V., p. 125-126. (Year: 1997).*

International Search Report and Written Opinion, International Application No. PCT/US2020/043995, dated Nov. 11, 2020, 14 pgs.

Auhorn, W.J. & Niemela, Klaus. (2007). Process chemicals for the production of chemical pulp. Professional Papermaking. 4. 10-20.

* cited by examiner

BLACK LIQUOR VISCOSITY REDUCING AND ANTI-SCALE AGENT

BACKGROUND

1. Field of the Invention

The present disclosure generally relates to compositions and methods for treating black liquor.

2. Description of the Related Art

The Kraft pulping process is one of the major pulping processes in the pulp and paper industry. Spent liquor ("black liquor") resulting from the kraft pulping process contains various organic materials as well as inorganic salts, the deposition of which detracts from an efficient chemical recovery cycle. Inorganic pulping chemicals and energy are recovered by incinerating black liquor in a recovery boiler. For an efficient combustion in the recovery boiler, black liquor coming from the pulp digesters with relatively low solids concentration needs to be evaporated and concentrated to at least 60% solids, typically in a multi-stage process (i.e., a multi-effect evaporator).

The weak black liquor entering the evaporators is about 15% solids but when it exceeds about 40% solids during the evaporation process, its rheology begins to have a thermoplastic behavior and its viscosity increases rapidly. This rheology change causes deposits and limitations of final solids in the strong black liquor inlet to the recovery boiler. Therefore, reducing the viscosity of the black liquor would be beneficial.

BRIEF SUMMARY

The present inventors determined that reducing the viscosity of the black liquor to a target range facilitates the evaporation process and increases the efficiency of the recovery boiler. The present application provides various compositions and methods to facilitate the viscosity reduction process.

In some embodiments, the present disclosure provides a composition comprising a carboxylate-containing polymer, an inorganic salt, and a surfactant.

The carboxylate-containing polymer may comprise a weight average molecular weight from about 500 Da to about 5,000 Da and may be selected from the group consisting of a polymer comprising a polyacrylate, a polymer comprising a sulfonate and a nonionic monomer, and any combination thereof. In some embodiments, the polymer comprising the polyacrylate further comprises a phosphonate. The phosphonate may be selected from the group consisting of a vinyl phosphonate, a vinyl diphosphonate, an allyl phosphonate, and any combination thereof.

In some embodiments, the nonionic monomer is selected from the group consisting of acrylamide, methacrylamide, N-methyl (meth)acrylamide, (meth)alkyl acrylamide, N,N'-dimethyl (meth)acrylamide, dialkyl (meth)acrylamide, 3-(dimethylamino)propyl methacrylamide (DMAPMA), 3-(dimethylamino)propyl acrylamide (DMAPA), N-vinyl pyrrolidone (NVP), styrene, an alkyl styrene, a vinyl ether, an allylic ether, and any combination thereof.

In certain embodiments, the carboxylate-containing polymer is sodium polyacrylate.

The inorganic salt may be selected from the group consisting of a bisulfite salt, a thiosulfate salt, a thiocyanate salt, and any combination thereof. For example, the inorganic salt may be selected from the group consisting of sodium bisulfite, sodium thiosulfate, sodium thiocyanate, potassium thiocyanate, and any combination thereof.

The surfactant may be selected from the group consisting of an ethoxylated alcohol, an ethoxylated-propoxylated copolymer, a sulfosuccinate salt, an ethoxylated fatty acid, and any combination thereof. The ethoxylated alcohol may be selected from the group consisting of ethoxylated tridecylalcohol, ethoxylated isotridecyl alcohol, ethoxylated isodecyl alcohol, ethoxylated lauryl alcohol, and any combination thereof.

In some embodiments, the composition comprises from about 5 to about 25 weight % of the inorganic salt, from about 1 to about 30 weight % of the surfactant, and from about 5 to about 20 weight % of the carboxylate-containing polymer.

In some embodiments, the composition further comprises black liquor.

The present disclosure also provides a method of reducing the viscosity of a black liquor. The method comprises adding an effective amount of a composition to the black liquor, and reducing the viscosity of the black liquor, wherein the composition comprises a carboxylate-containing polymer and an inorganic salt. In some embodiments, the composition may further comprise a surfactant.

The effective amount may be from about 100 ppm to about 10,000 ppm. In some embodiments, the viscosity may be reduced to an amount between about 15 cP and about 50 cP. The composition may be added at a time selected from the group consisting of when the black liquor comprises from about 15% solids to about 20% solids, when the black liquor comprises from about 35% solids to about 45% solids, when the black liquor comprises from about 55% solids to about 65% solids, and any combination thereof.

The present disclosure also provides a method of inhibiting scale deposition on a surface of an evaporator. The method comprises adding an effective amount of a composition to a black liquor, contacting the surface of the evaporator with the black liquor, and inhibiting scale deposition on the surface, wherein the composition comprises a carboxylate-containing polymer, an inorganic salt, and a surfactant.

The effective amount may be from about 100 ppm to about 10,000 ppm.

The scale may comprise a member selected from the group consisting of calcium carbonate, sodium carbonate, burkeite, magnesium hydroxide, calcium sulfate, sodium sulfate, and any combination thereof. In some embodiments, the scale comprises burkeite.

Additionally, the present disclosure provides a method of processing black liquor. The method comprises adding an effective amount of a composition to the black liquor, wherein the composition comprises a carboxylate-containing polymer, an inorganic salt, and a surfactant. The method also comprises condensing the black liquor to a solids level of about 40% or more, transporting the condensed black liquor to a recovery boiler, and incinerating the condensed black liquor in the recovery boiler.

The composition may be added at a time selected from the group consisting of when the black liquor comprises from about 15% solids to about 20% solids, when the black liquor comprises from about 35% solids to about 45% solids, when the black liquor comprises from about 55% solids to about 65% solids, and any combination thereof.

The effective amount may be from about 100 ppm to about 10,000 ppm.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which.

DETAILED DESCRIPTION

Figure 1:
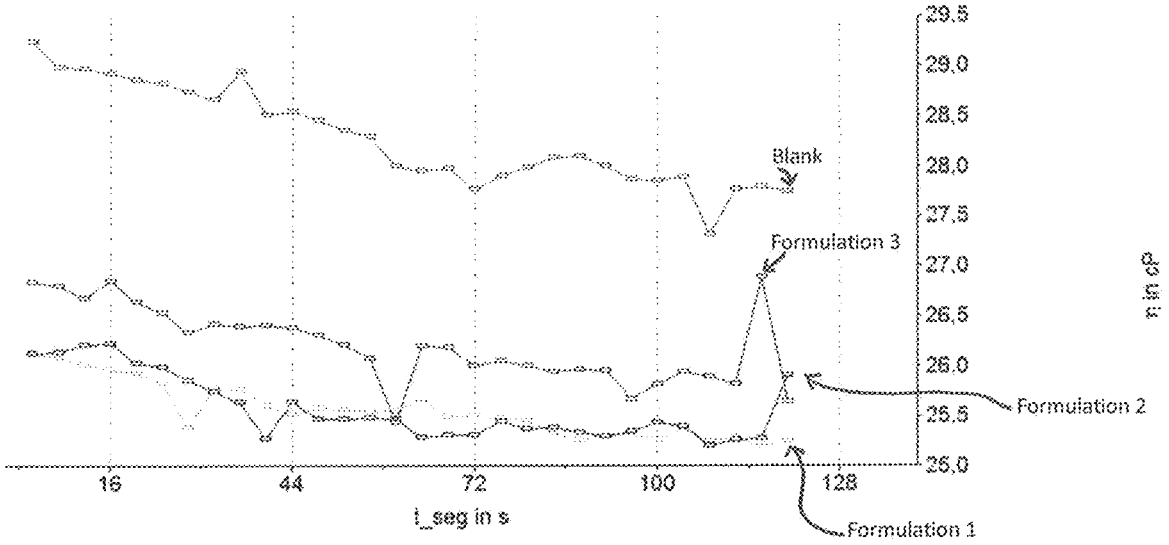
FIG. 1 shows viscosity reductions achieved using certain formulations of the present disclosure.

The present disclosure provides compositions and methods to improve the black liquor evaporation process and increase the performance of the recovery boiler, thereby improving pulp production. The presently disclosed compositions and methods reduce black liquor viscosity as well as organic and inorganic scale deposition in different stages of the evaporation process.

In accordance with the present disclosure, the term "black liquor" refers to a byproduct produced during the process of converting wood into wood pulp and then into paper. The liquor may comprise, for example, pulping residues, such as lignin and hemicellulose, in addition to chemicals from the Kraft process, such as sodium sulfide and/or sodium hydroxide.

In some embodiments, a composition of the present disclosure comprises a carboxylate-containing polymer and an inorganic salt. In some embodiments of the present disclosure, a composition comprises a carboxylate-containing polymer, an inorganic salt, and a surfactant. The compositions may comprise additional components, such as water.

Further, in some embodiments, a composition of the present disclosure may consist of or consist essentially of a carboxylate-containing polymer and an inorganic salt. A composition may also consist of or consist essentially of a carboxylate-containing polymer, an inorganic salt, and a surfactant. If a composition consists essentially of a carboxylate-containing polymer and an inorganic salt or if a composition consists essentially of a carboxylate-containing polymer, an inorganic salt, and a surfactant, the composition may also comprise water as this would not affect the basic and novel characteristics of the composition.

In some embodiments, the carboxylate-containing polymer comprises a weight average molecular weight from about 500 Da to about 5,000 Da. For example, in some embodiments, the molecular weight is from about 1,000 Da to about 4,500 Da, about 1,000 Da to about 3,000 Da, about 1,000 Da to about 2,000 Da, about 2,000 Da to about 4,000 Da, or about 3,000 Da to about 4,000 Da. In various embodiments, the molecular weight is about 2,000 Da or about 4,500 Da. In various embodiments, the molecular weight is from about 3,300 Da to about 3,900 Da.

The carboxylate-containing polymer is a polymer comprising at least one carboxylate functional group. In some embodiments, the carboxylate-containing polymer is selected from the group consisting of 1) a polymer comprising a polyacrylate, 2) a polymer comprising a sulfonate, a nonionic monomer, and a carboxylate, and 3) any combination of the foregoing. In some embodiments, the carboxylate-containing polymer comprises polyacrylate and a phosphonate. In some embodiments, the carboxylate-containing polymer is sodium polyacrylate.

Illustrative, non-limiting examples of sulfonate monomers include vinyl sulfonates, allylic sulfonates, styrene sulfonate, alkyl styrene sulfonates, 2-acrylamido-2-methylpropane sulfonate (AMPS), an acrylamido-methanesulfonate, and the like.

Illustrative, non-limiting examples of phosphonate monomers include vinyl phosphonates, vinyl diphosphonates, allyl phosphonates, and the like.

Illustrative, non-limiting examples of nonionic monomers include acrylamide, methacrylamide, N-methyl (meth)acrylamide, (meth)alkyl acrylamide, N,N'-dimethyl (meth)acrylamide, dialkyl (meth)acrylamide, 3-(dimethylamino)propyl methacrylamide (DMAPMA), 3-(dimethylamino)propyl acrylamide (DMAPA), N-vinyl pyrrolidone (NVP), styrene, alkyl styrene, vinyl ethers, allylic ethers, and the like.

In certain embodiments, the carboxylate-containing polymer is a terpolymer. For example, the terpolymer may comprise a strong acid monomer, a weak acid monomer, and a nonionic monomer.

Illustrative, non-limiting examples of strong acid monomers include vinyl sulfonates, allylic sulfonates, styrene sulfonate, alkyl styrene sulfonates, 2-acrylamido-2-methylpropane sulfonate (AMPS), an acrylamido-methanesulfonate, and the like.

Illustrative, non-limiting examples of weak acid monomers include acrylic acid, maleic acid, fumaric acid, propionic acid, malic acid, aspartic acid, succinic acid, a salt of polyaspartic acid, and a salt of polyepoxysuccinic acid (such as a sodium salt).

In some embodiments, the terpolymer has a weight average molecular weight of about 3,000 Da to about 6,000 Da or from about 4,000 Da to about 5,000 Da. In some embodiments, the terpolymer has a weight average molecular weight of about 4,500 Da.

The nonionic monomer is as defined above.

In some embodiments, the carboxylate-containing polymer is based on a phosphinopolycaboxylic acid. This carboxylate-containing polymer is referred to as "Polyacrylate 1" in the examples of the present application. In some embodiments, the phosphinopolycarboxylic acid may comprise the following general formula, where "m" and "n" are integers selected such that the carboxylate-containing polymer has a weight average molecular weight of about 3,300 Da to about 3,900 Da.

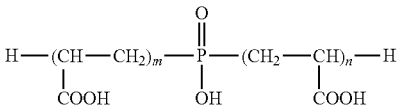

In some embodiments, the carboxylate-containing polymer is a polymer comprising one or more monomers selected from acrylic acid, maleic acid, and fumaric acid. For example, the polymer may comprise acrylic acid and maleic acid, acrylic acid and fumaric acid, or maleic acid and fumaric acid. In some embodiments, this carboxylate-containing polymer has a weight average molecular weight of about 1,500 Da to about 2,500 Da. In some embodiments, the molecular weight is about 2,000 Da. This carboxylate-containing polymer is referred to as "Polyacrylate 2" in the examples of the present application.

In some embodiments, the carboxylate-containing polymer is a terpolymer comprising sulfonic acid, a weak acid monomer as defined herein, and a nonionic monomer as defined herein. In some embodiments, the terpolymer has a weight average molecular weight of about 4,500 Da. This carboxylate-containing polymer is referred to as "Polyacrylate 3" in the examples of the present application.

In some embodiments, the carboxylate-containing polymer is a polyacrylate homopolymer. In some embodiments, this carboxylate-containing polymer has a weight average molecular weight of about 1,000 Da to about 3,000 Da. In some embodiments, the molecular weight is about 2,000 Da. This carboxylate-containing polymer is referred to as "Polyacrylate 4" in the examples of the present application.

The compositions disclosed in the present application may include varying amounts of each component, e.g., carboxylate-containing polymer. For example, in some embodiments, the composition may comprise about 5 to about 20 weight % of the carboxylate-containing polymer. In some embodiments, the composition comprises from about 5 to about 10, from about 5 to about 15, from about 10 to about 15, or from about 15 to about 20 weight % of the carboxylate-containing polymer.

The inorganic salt component of the presently disclosed compositions is not particularly limited. In some embodiments, the inorganic salt is selected from the group consisting of a bisulfite salt, a thiosulfate salt, a thiocyanate salt, and any combination thereof.

For example, the inorganic salt may be selected from the group consisting of sodium bisulfite (CAS 7631-90-5), sodium thiosulfate (CAS 7772-98-7), sodium thiocyanate (CAS 540-72-7), potassium thiocyanate (CAS 333-20-0), and any combination thereof.

The compositions disclosed in the present application may include varying amounts of each component, e.g., inorganic salt. For example, in some embodiments, the composition may comprise about 5 to about 25 weight % of the inorganic salt. In some embodiments, the composition comprises from about 5 to about 10, from about 5 to about 15, from about 10 to about 15, or from about 15 to about 20 weight % of the inorganic salt. In some embodiments, the composition comprises about 5 weight % or about 10 weight % of the inorganic salt.

The surfactant component of the compositions disclosed in the present application is not particularly limited. In some embodiments, the surfactant is selected from the group consisting of an ethoxylated alcohol, an ethoxylated-propoxylated copolymer, a sulfosuccinate salt, an ethoxylated fatty acid, and any combination thereof.

Illustrative, non-limiting examples of ethoxylated alcohols may be selected from the group consisting of ethoxylated tridecylalcohol (CAS 78330-21-9), ethoxylated isotridecyl alcohol, ethoxylated isodecyl alcohol, and ethoxylated lauryl alcohol.

Illustrative, non-limiting examples of ethoxylated-propoxylated copolymers may be selected from the group consisting of polyoxypropylene-polyoxyethylene block copolymer (CAS 11/6/9003), ethoxylated polypropyleneglycol, and propoxylated polypropyleneglycol.

Illustrative, non-limiting examples of sulfosuccinate salts include sulfosuccinate sodium salts, such as dioctyl sulfosuccinate sodium salt (CAS 577-11-7). In place of, or in addition to, the sulfosuccinate salt(s), one could use, for example, sodium lauryl ether sulfate or sodium lauryl sulfate.

Illustrative, non-limiting examples of ethoxylated fatty acids include tall oil fatty acids. The term "tall oil" encompasses various components. For example, a tall oil fatty acid composition generally includes about 90% or more fatty acids. However, a crude tall oil fatty acid composition may include about 50% fatty acids and slightly less rosin acids. In some embodiments, the particular fatty acids include palmitic acid, stearic acid, oleic acid, and linoleic acid, with oleic and linoleic acid being present in the largest amounts.

In some embodiments, the surfactant comprises ethoxylated tall oil fatty acids (CAS 61791-00-2). In some embodiments, the surfactant comprises a polyethylene glycol ester.

The compositions disclosed in the present application may include varying amounts of each component, e.g., surfactant. For example, in some embodiments, the composition may comprise about 1 to about 30 weight % of the surfactant. In some embodiments, the composition comprises from about 1 to about 5, from about 1 to about 10, from about 5 to about 15, from about 10 to about 20, or from about 5 to about 25 weight % of the surfactant.

Additionally, the compositions of the present disclosure may comprise an amount of water. In some embodiments, the compositions comprise from about 50 to about 85 weight % water. For example, in some embodiments, the compositions comprise from about 55 to about 80, about 60 to about 80, about 65 to about 80, or about 65 to about 75 weight % water. In certain embodiments, the compositions comprise about 65, about 70, or about 75 weight % water.

In accordance with various embodiments disclosed in the present application, the compositions may be used in methods of reducing the viscosity of black liquor. An effective amount of a composition disclosed herein may be added to the black liquor to carry out the viscosity reduction. In some embodiments, the composition comprises a carboxylate-containing polymer and an inorganic salt. In some embodiments, the composition comprises a carboxylate-containing polymer, an inorganic salt, and a surfactant.

The effective amount added to the black liquor depends on a variety of factors, such as concentrations of salts in the black liquor, temperature, flow of the black liquor, and product feed point. In some embodiments, the effective amount is from about 100 ppm to about 10,000 ppm, based on black liquor. For example, the effective amount may be from about 100 ppm to about 5,000 ppm, from about 100 ppm to about 2,500 ppm, from about 100 ppm to about 1,000 ppm, from about 100 ppm to about 500 ppm, from about 500 ppm to about 5,000 ppm, from about 500 ppm to about 2,500 ppm, from about 500 ppm to about 1,000 ppm, from about 1,000 ppm to about 10,000 ppm, from about 1,000 ppm to about 5,000 ppm, from about 1,000 ppm to about 2,500 ppm, from about 3,000 ppm to about 10,000 ppm, or from about 5,000 ppm to about 10,000 ppm.

The compositions of the present disclosure may be added at various locations in the process. For example, a composition may be added to the black liquor before it enters an evaporator, it may be added to the black liquor inside of the evaporator, or it may be added to the black liquor before it enters the evaporator and again (one or more times) while the black liquor is inside of the evaporator.

In some embodiments, when the black liquor enters the evaporator, it may comprise about 15% solids. A composition of the present disclosure may be added at that time. During the evaporation process, the black liquor may become condensed and comprise about 40% solids. A composition of the present disclosure may be added at that time. At the conclusion of the evaporation process, the black liquor may comprise about 60 to about 70% solids. A composition of the present disclosure may be added at that time.

In some embodiments, the composition is added at a time selected from the group consisting of when the black liquor comprises from about 15% solids to about 20% solids, when the black liquor comprises from about 35% solids to about 45% solids, when the black liquor comprises from about 55% solids to about 65% solids, and any combination thereof.

Certain methods disclosed herein contemplate reducing the viscosity of the black liquor to a target range. In some embodiments, the target range is from about 15 cP to about 500 cP. For example, the target range may be from about 15 cP to about 250 cP, from about 15 cP to about 100 cP, from about 15 cP to about 50 cP, from about 15 cP to about 28 cP, from about 20 cP to about 100 cP, from about 20 cP to about 50 cP, from about 20 cP to about 28 cP, from about 25 cP to about 28 cP, or from about 25 cP to about 26.5 cP.

The inventors unexpectedly determined that lowering the viscosity of the black liquor as much as possible is not desirable. For example, the inventors determined that excessively low viscosity can cause inefficiency in the firing of the recovery boiler. As such, reducing the viscosity of the black liquor to a target range is beneficial.

The present disclosure also provides methods of inhibiting scale deposition on a surface of an evaporator. An effective amount of a composition of the present disclosure may be added to the black liquor and the black liquor may be allowed to contact a surface of the evaporator. The composition of the present disclosure inhibits scale deposition on the surface.

In some embodiments, the composition used in the method of inhibiting scale deposition comprises a carboxylate-containing polymer, an inorganic salt, and a surfactant.

As described above, the effective amount added to the black liquor is from about 100 ppm to about 5,000 ppm, from about 100 ppm to about 2,500 ppm, from about 100 ppm to about 1,000 ppm, from about 100 ppm to about 500 ppm, from about 500 ppm to about 5,000 ppm, from about 500 ppm to about 2,500 ppm, from about 500 ppm to about 1,000 ppm, from about 1,000 ppm to about 10,000 ppm, from about 1,000 ppm to about 5,000 ppm, from about 1,000 ppm to about 2,500 ppm, from about 3,000 ppm to about 10,000 ppm, or from about 5,000 ppm to about 10,000 ppm.

The compositions of the present disclosure can prevent deposition of many different types of scale. In some embodiments, the scale comprises a member selected from the group consisting of calcium carbonate, sodium carbonate, burkeite, magnesium hydroxide, calcium sulfate, sodium sulfate, and any combination thereof. In some embodiments, the scale comprises burkeite.

The present inventors determined that the use of polyacrylates only has an effect on the reduction of calcium carbonate deposits. It was found that the polyacrylates had no meaningful effect on the reduction of burkeite scale, which is present in larger quantities in the evaporators.

However, the inventors discovered a synergistic combination of components that is capable of inhibiting deposition of burkeite scale. In some embodiments, the synergistic combination includes the presently disclosed carboxylate-containing polymer and the inorganic salt. In some embodiments, the synergistic combination includes the presently disclosed carboxylate-containing polymer, the inorganic salt, and the surfactant.

In the presently disclosed methods of inhibiting scale deposition, a composition may be added to the black liquor before it enters an evaporator, it may be added to the black liquor inside of the evaporator, or it may be added to the black liquor before it enters the evaporator and again (one or more times) while the black liquor is inside of the evaporator.

For example, a composition may be added when the black liquor comprises about 15% solids, about 40% solids, about 60% to about 70% solids, or any combination thereof.

In some embodiments, the composition is added at a time selected from the group consisting of when the black liquor comprises from about 15% solids to about 20% solids, when the black liquor comprises from about 35% solids to about 45% solids, when the black liquor comprises from about 55% solids to about 65% solids, and any combination thereof.

Still further, the present disclosure provides methods of processing black liquor. The methods comprise adding an effective amount of a composition disclosed herein to the black liquor. In some embodiments, the composition comprises a carboxylate-containing polymer, an inorganic salt, and a surfactant.

The methods may further comprise the steps of condensing the black liquor to a solids level of about 40% or more, transporting the condensed black liquor to a recovery boiler, and incinerating the condensed black liquor in the recovery boiler.

In the presently disclosed methods of processing black liquor, a composition may be added to the black liquor before it enters an evaporator, it may be added to the black liquor inside of the evaporator, or it may be added to the black liquor before it enters the evaporator and again (one or more times) while the black liquor is inside of the evaporator.

For example, a composition may be added when the black liquor comprises about 15% solids, about 40% solids, about 60% to about 70% solids, or any combination thereof.

In some embodiments, the composition is added at a time selected from the group consisting of when the black liquor comprises from about 15% solids to about 20% solids, when the black liquor comprises from about 35% solids to about 45% solids, when the black liquor comprises from about 55% solids to about 65% solids, and any combination thereof.

The effective amount added to the black liquor is from about 100 ppm to about 5,000 ppm, from about 100 ppm to about 2,500 ppm, from about 100 ppm to about 1,000 ppm, from about 100 ppm to about 500 ppm, from about 500 ppm to about 5,000 ppm, from about 500 ppm to about 2,500 ppm, from about 500 ppm to about 1,000 ppm, from about 1,000 ppm to about 10,000 ppm, from about 1,000 ppm to about 5,000 ppm, from about 1,000 ppm to about 2,500 ppm, from about 3,000 ppm to about 10,000 ppm, or from about 5,000 ppm to about 10,000 ppm.

Examples

In a first set of experiments, black liquor was obtained and treated with Formulations 1-3 as defined in Table 1. Formulation 4 was not tested.

TABLE 1

| Raw Material | CAS# | 1 | 2 | 3 | 4 |
|---|---|---|---|---|---|
| Ethoxylated tall oil (or soybean oil) | 61791-00-2 | 5% | 0% | 10% | 5% |
| Ethoxylated alcohol (isotrydecilic) | 78330-21-9 | 12% | 14% | 10% | 12% |
| Ethoxylated C10-C16 alcohols | 68002-97-1 | 0% | 0% | 0% | 0% |
| Di(2-Ethylhexyl) Sodium Sulfosuccinate | 577-11-7 | 1% | 1% | 0% | 1% |
| d-Limonene | 5989-27-5 | 0% | 5% | 0% | 0% |
| Ethylene Oxide - Propylene Oxide Copolymer | 9003-11-6 | 2% | 0% | 0% | 2% |
| Sodium polyacrylate | 9003-04-7 | 10% | 10% | 10% | 5% |
| Maleic acid, sodium salt polymer with acrylic acid, sodium salt | 152261-37-5 | 0% | 0% | 0% | 5% |
| Water | 7232-18-5 | 70% | 70% | 70% | 70% |

About 900 grams of black liquor was separated and baseline viscosity and solids measurements were carried out. The black liquor was then heated to a temperature of about 80° C. until the liquor had a solids content of about 50% to about 55%. Solids content was determined by placing about 2 grams of black liquor on a solids balance. The viscosity of the liquor was then measured. Specifically, about 10 mL of heated black liquor was taken and placed in a sample adapter of the viscometer. The RPM was adjusted until the torque reached a value greater than about 50%. The liquor was heated again to about 80° C. for about 10 minutes and solids content and viscosity were once again determined. These steps were repeated until the black liquor had a solids content between about 60% and about 65%.

The foregoing experimental procedure was carried out four different times. The first time, Formulation 1 was added after taking the baseline measurements but before heating started. The second time, Formulation 2 was added after taking the baseline measurements but before heating started. The third time, Formulation 3 was added after taking the baseline measurements but before heating started. The fourth time, no formulation was added.

FIG. 1 depicts the results of the viscosity tests. As can be seen, Formulation 1 achieved the greatest viscosity reduction but all formulations achieved a reduction in viscosity as compared to "blank."

Figure 2:
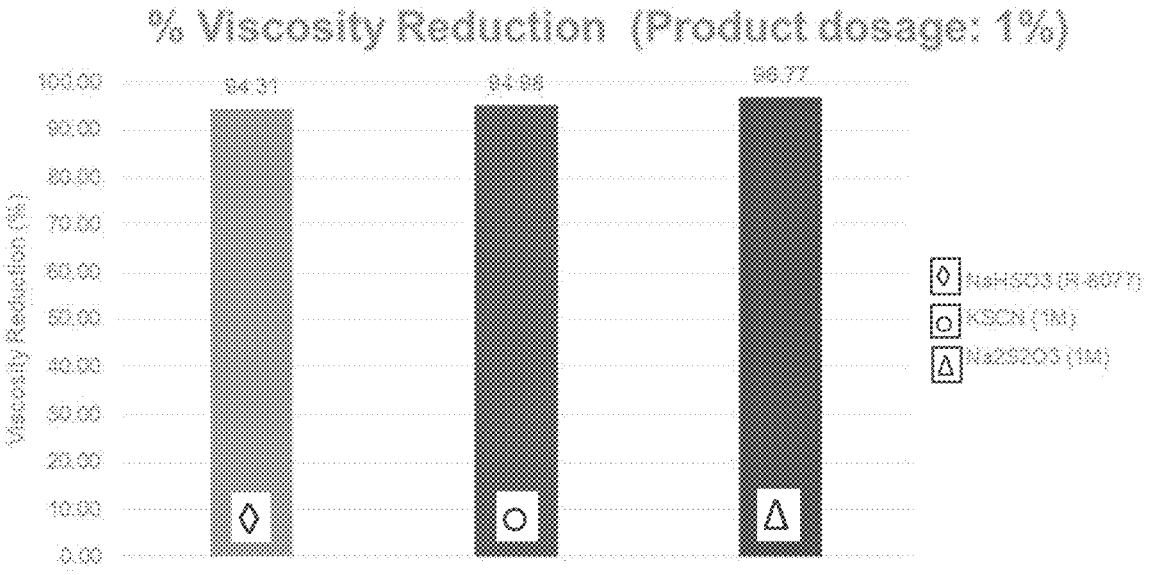
FIG. 2 shows viscosity reductions achieved using certain inorganic salts of the present disclosure.

In another set of experiments, various inorganic salts were tested to determine their effect on black liquor viscosity. The same experimental procedures outlined above were utilized with the inorganic salts. As can be seen in FIG. 2, all three inorganic salts were able to significantly reduce the viscosity of the black liquor. Each salt was added at about 1% by weight of the sample of black liquor.

Figure 3:
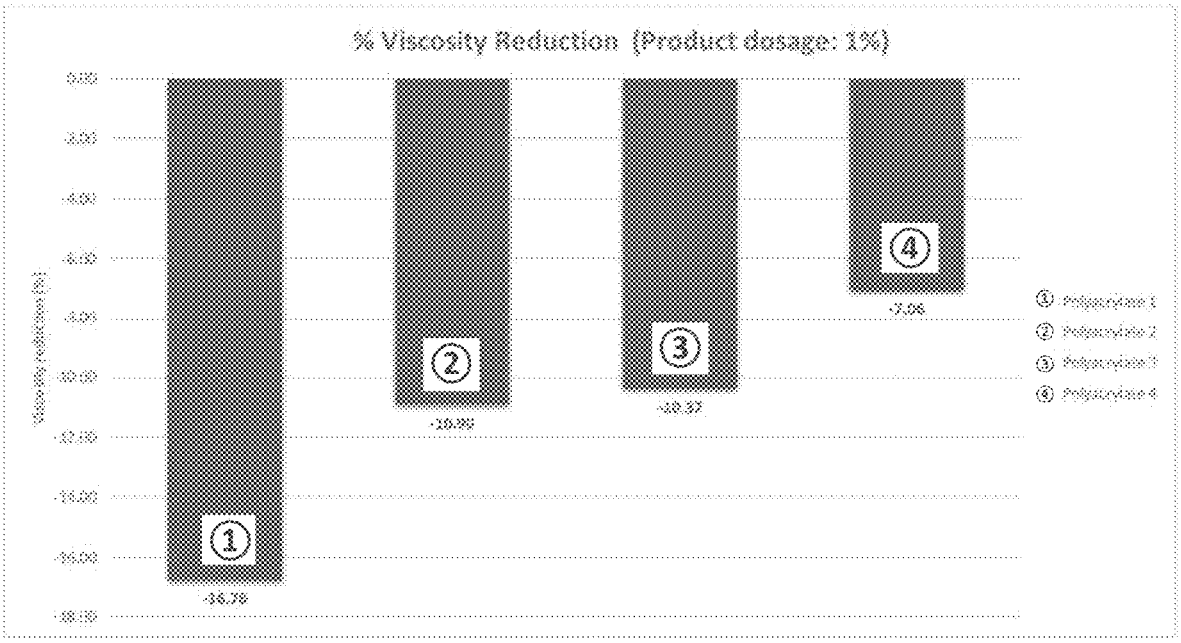
FIG. 3 shows viscosity increases achieved using certain polyacrylates of the present disclosure.

Additional viscosity tests were carried out according to the procedures outlined above but instead of testing inorganic salts, various polyacrylates were tested, i.e., Polyacrylates 1-4 (as defined above). As can be seen in FIG. 3, all of the polyacrylates increased the viscosity of the black liquor. Based on this data, if one were to feed only polyacrylate into the black liquor, the evaporator may be kept free of deposits but there would be an increase in black liquor viscosity, which would be harmful to the efficiency of the overall evaporation process.

Further experiments were conducted to test the effectiveness of the following products:

Product 1: This product contained about 7 wt. % esters (soybean fatty acid esters and/or tall oil fatty esters with polyethylene glycol), about 15 wt. % ethoxylated alcohol (ethoxylated isotridecyl alcohol (9 EO)), and about 10 wt. % of an acrylic acid homopolymer (Polyacrylate 4).

Product 2: This product contained about 10 wt. % thiocyanate (sodium and/or potassium thiocyanate) and about 10 wt. % of an acrylic acid homopolymer (Polyacrylate 4).

Product 3: This product contained about 10 wt. % thiocyanate (sodium and/or potassium thiocyanate), about 5 wt. % ethoxylated alcohol (ethoxylated isotridecyl alcohol (9 EO)), and about 10 wt. % of an acrylic acid homopolymer (Polyacrylate 4).

The balance of each product was water.

Figure 4:
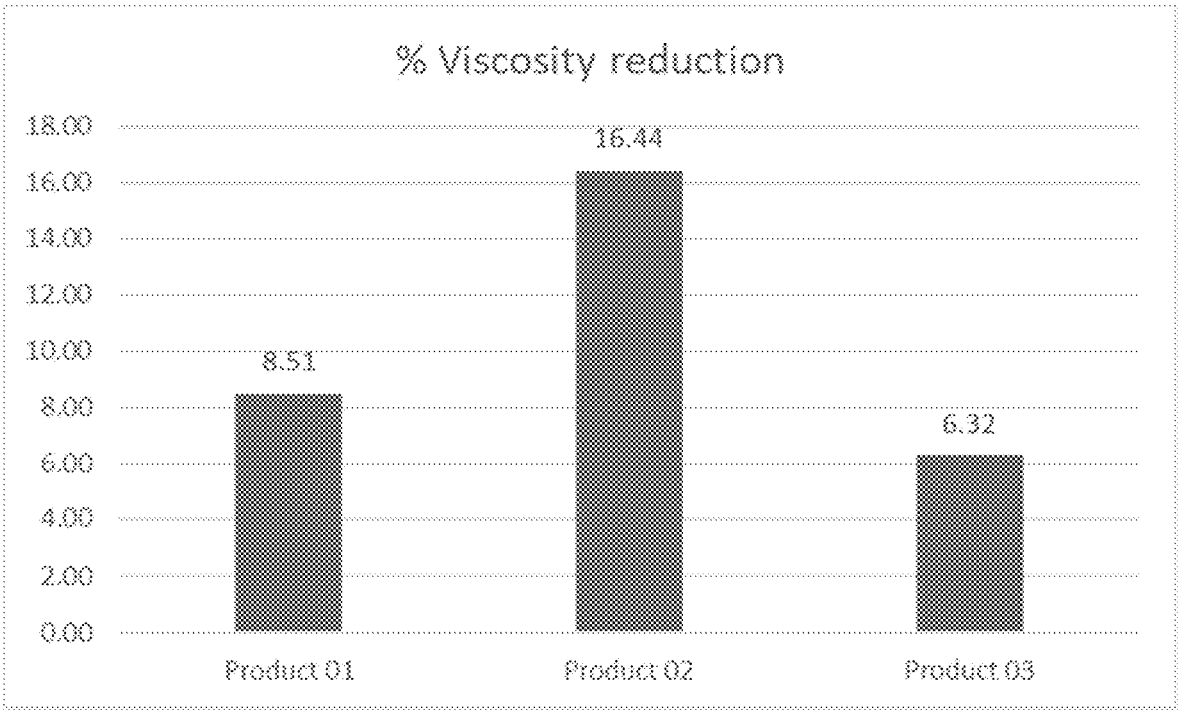
FIG. 4 shows viscosity reductions achieved using certain products disclosed in the present application.

The same experimental steps outlined above were carried out in connection with Products 1-3. As can be seen in FIG. 4, the inventors discovered synergism between various components, such as between carboxylate-containing polymers (e.g., polyacrylates) and inorganic salts and/or surfactants. The inorganic salts and/or surfactants reduce the negative impact of carboxylate-containing polymers on black liquor viscosity. This result was not expected based on current knowledge in the art.

Figure 5:
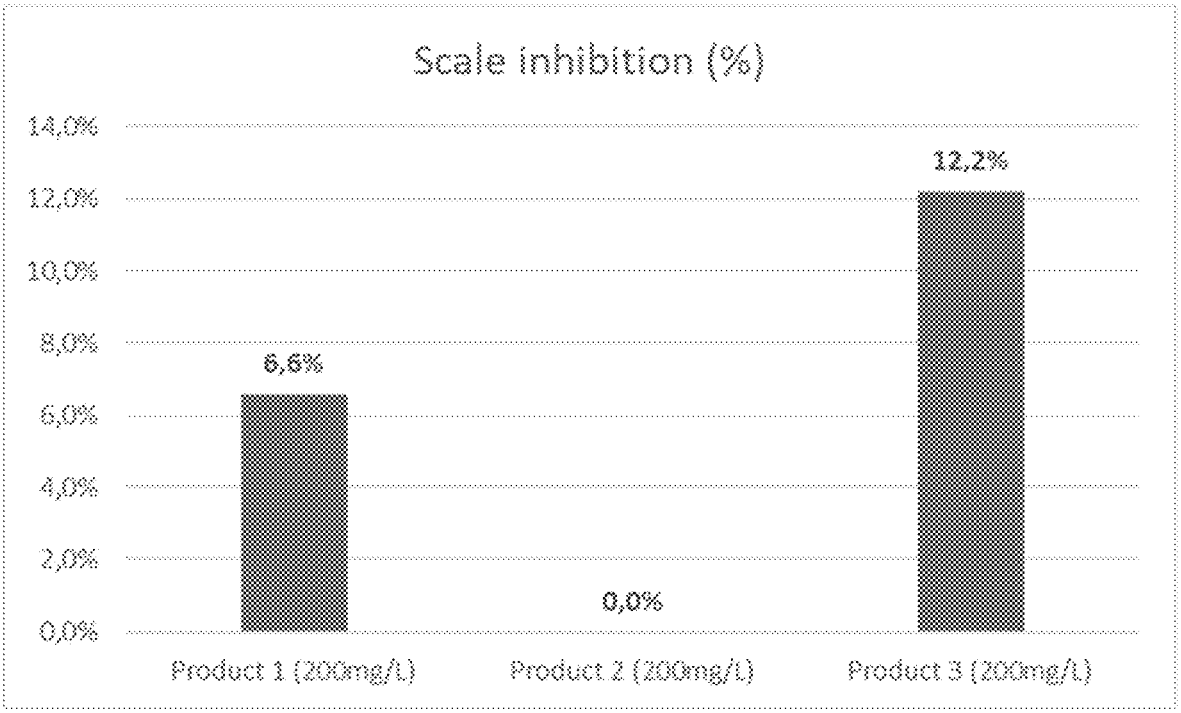
FIG. 5 shows scale inhibition achieved using certain products disclosed in the present application.

In addition to testing viscosity reduction, scale inhibition was also studied and as can be seen in FIG. 5, Products 1 and 3 displayed effectiveness (as determined by SRM (scale rate monitor)) with inhibiting inorganic scale deposition. It was also determined, by visual inspection, that Product 1 provided superior dispersion of salts of sodium sulfate and carbonate.

Any composition disclosed herein may comprise, consist of, or consist essentially of any of the compounds/components disclosed herein. In accordance with the present disclosure, the phrases "consist essentially of," "consists essentially of," "consisting essentially of," and the like limit the scope of a claim to the specified materials or steps and those materials or steps that do not materially affect the basic and novel characteristic(s) of the claimed invention.

As used herein, the term "about" refers to the cited value being within the errors arising from the standard deviation found in their respective testing measurements, and if those errors cannot be determined, then "about" refers to within 5% of the cited value.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a phosphonate" is intended to include "at least one phosphonate" or "one or more phosphonates."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method of reducing a viscosity of a black liquor, comprising:

adding an effective amount of a composition to the black liquor, and reducing the viscosity of the black liquor, wherein the composition comprises an inorganic salt and a carboxylate-containing polymer, wherein the inorganic salt comprises a bisulfite salt, and wherein the carboxylate-containing polymer is selected from the group consisting of a polyacrylate, polymer comprising sulfonate and a nonionic monomer, a polymer comprising a polyacrylate and a phosphonate, and any combination thereof.

2. The method of claim 1, wherein the composition further comprises a surfactant.

3. The method of claim 1, further comprising:

concentrating the black liquor to a solids level of about 40% or more;

transporting the condensed black liquor to a recovery boiler; and incinerating the condensed black liquor in the recovery boiler.

4. The method of claim 1, wherein the effective amount is from about 100 ppm to about 10,000 ppm.

5. The method of claim 1, wherein the viscosity is reduced to an amount between about 15 cP and about 50 cP.

6. The method of claim 1, wherein the composition is added at a time selected from the group consisting of when the black liquor comprises from about 15% solids to about 20% solids, when the black liquor comprises from about 35% solids to about 45% solids, when the black liquor comprises from about 55% solids to about 65% solids, and any combination thereof.

7. A method of inhibiting scale deposition on a surface of an evaporator, comprising:

adding an effective amount of a composition to a black liquor, contacting the surface of the evaporator with the black liquor, and inhibiting scale deposition on the surface, wherein the composition comprises an inorganic salt, a surfactant, and a carboxylate-containing polymer, wherein the inorganic salt comprises a bisulfite salt, and wherein the carboxylate-containing polymer is selected from the group consisting of a polyacrylate, a polymer comprising sulfonate and a nonionic monomer, a polymer comprising a polyacrylate and a phosphonate, and any combination thereof.

8. The method of claim 7, wherein the scale comprises burkeite.

* * * * *